US006840228B2

(12) United States Patent
Yomogida et al.

(10) Patent No.: US 6,840,228 B2
(45) Date of Patent: Jan. 11, 2005

(54) FILTER PROCESSING DEVICE FOR DETECTING VALUES OF COMMON RAIL PRESSURE AND COMMON RAIL FUEL INJECTION CONTROL DEVICE

(75) Inventors: Koichiro Yomogida, Fujisawa (JP); Futoshi Nakano, Fujisawa (JP); Yusuke Saigo, Fujisawa (JP); Yuji Sasaki, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 10/725,664

(22) Filed: Dec. 2, 2003

(65) Prior Publication Data

US 2004/0107944 A1 Jun. 10, 2004

(30) Foreign Application Priority Data

Dec. 3, 2002 (JP) ..... 2002-351175

(51) Int. Cl.[7] ..... F02M 51/00

(52) U.S. Cl. ..... 123/494; 123/456; 123/447

(58) Field of Search ..... 123/494, 467, 123/357, 456, 447, 497, 458, 490, 488; 73/119 A, 116, 117.2

(56) References Cited

U.S. PATENT DOCUMENTS 5,535,621 A * 7/1996 Glidewell et al. ..... 73/119 A
5,699,772 A * 12/1997 Yonekawa et al. ..... 123/497
5,732,675 A * 3/1998 Yoshida et al. ..... 123/305
6,085,727 A * 7/2000 Nakano ..... 123/447
6,102,009 A * 8/2000 Nishiyama ..... 123/490
6,170,459 B1 * 1/2001 Ono et al. ..... 123/305

FOREIGN PATENT DOCUMENTS

| | | |
|---|---|---|
| JP | 63-050649 | 3/1998 |
| JP | 11-030150 | 2/1999 |
| JP | 2000-257478 | 9/2000 |

* cited by examiner

*Primary Examiner*—Carl S. Miller
(74) *Attorney, Agent, or Firm*—McCormick, Paulding & Huber LLP

(57) ABSTRACT

The detected values of a common rail pressure that were detected by a pressure sensor are read within crank angle periods Δt which are at least not more than half of a pumping cycle ΔT of a supply pump, the values detected within one pumping cycle preceding a reading time (for example, S(1), S(0), . . . S(−4)) are averaged during each of the reading times, and the value thus obtained (for example, Pav(1)) is used as a common rail pressure after averaging processing, which is a representative value or a control value of the actual common rail pressure. The feedback control of common rail pressure is executed by using the values of common rail pressure after averaging processing thus computed by moving averaging. Consequently, the actual common rail pressure is converted into values suitable for control, and the feedback control of common rail pressure is executed with higher accuracy.

3 Claims, 5 Drawing Sheets

FILTER PROCESSING DEVICE FOR DETECTING VALUES OF COMMON RAIL PRESSURE AND COMMON RAIL FUEL INJECTION CONTROL DEVICE

CROSS REFERENCE TO RELATED APPLICATION

Applicants hereby claim foreign priority benefits under U.S.C. § 119 of Japanese Patent Application No. 2002-351175, filed on Dec. 3, 2002, and the content of which is herein incorporated by reference.

BACKGROUND OF THE INVENTION

1. Field of the Invention

The present invention relates to a common rail fuel injection control device applied to diesel engines, more specifically to a device, which executes feedback control of common rail pressure, for converting the actual common rail pressure into values suitable for control, and to a method therefor.

2. Description of the Related Art

Common rail fuel injection control devices for diesel engines in which a common rail pressure is feedback controlled for optimizing the injection pressure according to the operation state of the engine, such as revolution speed and load, are well known.

In such a feedback control, the control is conducted so as to match the actual common rail pressure with a target common rail pressure determined based on the engine operation state. More specifically, the control is executed based on the difference between those pressures. Accordingly, the detection of the actual common rail pressure with a pressure sensor has been carried out. Typically, in this control, the values detected by the pressure sensor are directly used as representative values of the actual common rail pressure (for example, Japanese Patent Application Laid-open No. H11-30150 (paragraph 0018), Japanese Patent Application Laid-open No. S63-50649 (page 5), and Japanese Patent Application Laid-open No. 2000-257478 (page 5)).

Because fuel supply into a common rail is conducted by a supply pump pumping the fuel within the prescribed periods, pulsations caused by pumping with the supply pump occur in the actual common rail pressure. Those pressure pulsations are shown with the diagram denoted by "Real Rail Pressure" in FIG. 1 and the diagram denoted by "Actual Pressure (Related Art)" in FIG. 2. FIG. 1 is shown on a macro scale in FIG. 2.

As shown in FIG. 1, in this example, fuel pumping with the supply pump is conducted in $\Delta T=180$ CA (180° crank angle, same hereinbelow) periods, and the control period of the control device is $\Delta t=30$ CA (⅙ of the pump pumping cycle $\Delta T$). As shown by black dots, the values detected by the pressure sensor (sensor detected values) are read by a controller every control period $\Delta t$. The control is usually conducted by using the sensor detected values as the representative values of the actual common rail pressure.

However, the sensor detected values also greatly fluctuate according to pulsations of the actual common rail pressure. Therefore, in the feedback control, especially the PID control, the difference between the target value and actual value and also the values of the proportional term and differential term determined based on this difference always vary significantly. As a result, directly using the sensor detected values create a risk of degrading the controllability.

The diagram denoted by "Differential Term (Related Art)" in FIG. 2 is a differential term calculated by using the sensor detected values. This figure demonstrates that the differential term constantly changes, and using the value thereof is clearly undesirable.

When conducting control by using such fluctuating sensor detected values, setting a feedback control gain to a comparatively small value can be considered. However, such an approach degrades the responsiveness of the feedback control.

Accordingly, filtering processing conducted to average a plurality of sensor detected values obtained within the prescribed interval can be considered. The problems are, however, that setting the averaging interval is inappropriate: when it is too long, it causes a response delay, and when it is too short, the fluctuations cannot be completely eliminated.

SUMMARY OF THE INVENTION

It is an advantage of the present invention that was conceived with the above-described problems in view to convert the actual common rail pressure into values that can be advantageously used for control and to conduct the feedback control of common rail pressure with higher accuracy.

The present invention provides a filter processing device for detected values of common rail pressure, comprising a common rail for accumulating a high-pressure fuel, a supply pump synchronously driven by an engine and pumping the fuel to the common rail in constant pumping cycles, a pressure sensor for detecting the actual common rail pressure, and computation means for reading the detected values of the common rail pressure obtained by the pressure sensor within crank angle periods which are at least not more than half of the pumping cycle, averaging, the values detected within one pumping cycle preceding each of the reading time, and using the value thus obtained as a common rail pressure after averaging processing, which is a representative value of the actual common rail pressure.

The present invention also provides a common rail fuel injection control device comprising means for determining a target common rail pressure based on the actual engine operation state and pump pumping quantity control means for computing the difference between the target common rail pressure and the actual common rail pressure and feedback controlling the pumping quantity of a supply pump based on the aforesaid difference so that the actual common rail pressure coincides with the target common rail pressure, wherein the pump pumping quantity control means uses the values of the common rail pressure after averaging processing that were obtained by the above-described filter processing device for detected values of common rail pressure, as the representative value of the actual common rail pressure.

The pump pumping quantity control means may use, as the representative values of the actual common rail pressure, the values of the common rail pressure after averaging processing only when the engine revolution speed is not less than a prescribed value, and directly may use the detected values that were detected by the pressure sensor for each prescribed time period when the engine revolution speed is less than the prescribed value.

DESCRIPTION OF THE PREFERRED EMBODIMENTS

The preferred embodiment of the present invention will be described hereinbelow with reference to the accompanying drawings.

Figure 3:
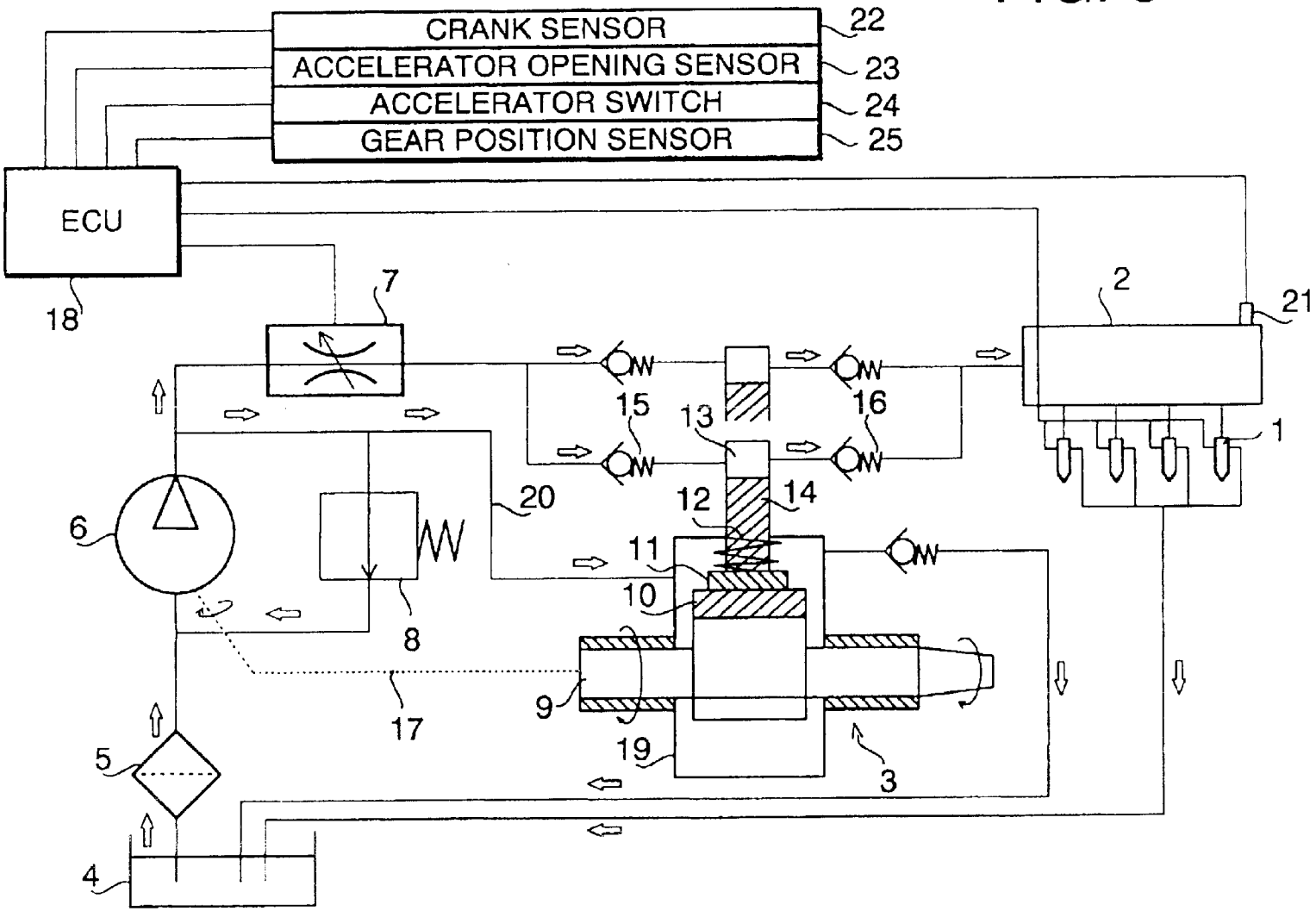
FIG. 3 is a system drawing of a common rail fuel injection control device of the present embodiment.

FIG. 3 shows the entire configuration of the common rail fuel injection control device of the present embodiment. This device is employed for executing fuel injection control in a four-cylinder diesel engine (not shown in the figure) carried on a vehicle.

An injector 1 is provided in each cylinder of the engine, and a high-pressure fuel under a common-rail pressure (from several tens to several hundreds of MPa), which is stored in a common rail 2, is regularly supplied to each injector 1. Pumping of fuel into the common rail 2 is carried out by a supply pump 3. Thus, a fuel (light oil) at about a normal pressure which is present in a fuel tank 4 is sucked in by a feed pump 6 via a fuel filter 5 and transferred from the feed pump 6 into the supply pump 3. The supply pump 3 applies pressure to the fuel and pumps it into the common rail 2.

A metering valve 7 for adjusting the amount of fuel supplied to the supply pump 3 is installed between the feed pump 6 and the supply pump 3. The metering valve 7 is composed of an electromagnetic valve. Furthermore, a relief valve 8 for adjusting the outlet pressure of the feed pump 6 is provided in parallel with the feed pump 6.

The supply pump 3 is mainly composed of a pump shaft 9 driven synchronously by the engine, a cam ring 10 fit on the outer periphery of the pump shaft 9, a tappet 11 in a sliding contact with the outer periphery of the cam ring 10, a pressure spring 12 for pressing the tappet 11 against the cam ring 10, a plunger 14 which is lifted at the same time as the tappet 11 is lifted by the cam ring 10 and applies pressure to the fuel in a plunger chamber 13, and check valves 15, 16 provided respectively in the inlet portion and outlet portion of the plunger chamber 13.

The tappet 11, pressure spring 12, plunger chamber 13, plunger 14, and check valves 15, 16 constitute a pumping unit. Two such pumping units are provided with a 180° spacing around the pump shaft 9. As a result, the supply pump 3 pumps the fuel twice per one pump revolution. For the sake of convenience, in the figure, the two pumping units are shown in a plan view thereof.

The pump shaft 9 of the supply pump 3 and the pump shaft (not shown in the figure) of the feed pump 6 are connected to the engine with mechanical connection means 17 such as a chain mechanism, a belt mechanism, or a gear mechanism. As a result, the supply pump 3 and the feed pump 6 are driven synchronously by the engine.

Figure 1:
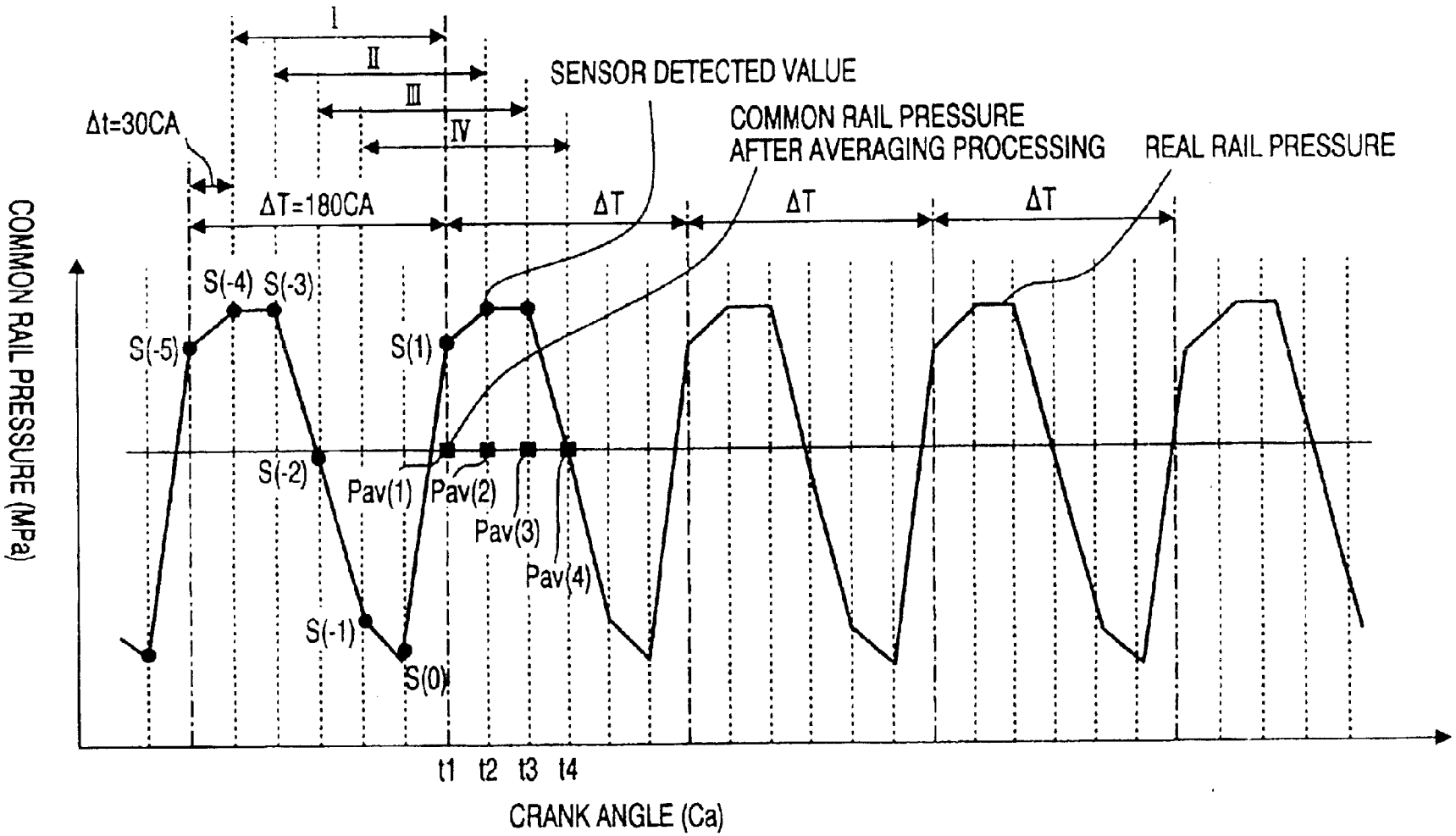
FIG. 1 is a diagram for explaining the filtering processing of the detected values of common rail pressure of an embodiment of the present invention.

In particular, the supply pump 3 is rotary driven at a revolution ratio of 1:1 with the crankshaft of the engine, that is, pumping of the fuel is conducted periodically at a ratio of two times per one revolution of the crankshaft. FIG. 1 shows a pattern of fuel pumping of the present embodiment. As shown in the figure, the pumping cycle of the supply pump 3 is $\Delta T=180$ CA. The expression "real rail pressure" relates to an actual common rail pressure. This increase in pressure is due to the pumping by the supply pump, whereas the pressure drop is due to fuel leak from the injectors. As described hereinabove, the engine has four cylinders, and the fuel pumping cycle of the supply pump 3 and the fuel injection period of the injector 1 are synchronized.

The flow of fuel in this device is shown by arrows in FIG. 3. Thus, the fuel present in the fuel tank 4, is supplied, after passing through the fuel filter 5, into the feed pump 6 and then into the metering valve 7. The outlet pressure of the feed pump 6 is adjusted by the relief valve 8, and the excess fuel that has passed through the relief valve 8 returns to the inlet side of the feed pump 6. The degree of opening and the opening/closing timing of the metering valve 7 are controlled by an electronic control unit (referred to hereinbelow as ECU) 18 serving as a controller. When the valve is open, the fuel is discharged toward the pumping unit of the supply pump 3 in an amount corresponding to the degree of opening and opening period.

The discharged fuel pushes and opens the inlet check valve 15 and is introduced into the plunger chamber 13. The lift of the plunger 14 raises the pressure, and once the pressure rises to a level exceeding the opening pressure of the outlet check valve 16, the fuel pushes and opens the outlet check valve 16 and is introduced into the common rail 2. As a result, the common rail pressure is increased by the amount balanced with the amount of fuel discharged from the metering valve 7. The fuel present in the common rail 2 is constantly supplied to the injectors 1, and when the injectors 1 are open, the fuel of the common rail 2 is injected into the cylinders.

Furthermore, the leak fuel discharged from the injectors 1 is directly returned into the fuel tank 4. Furthermore, the fuel at the outlet side of the feed pump 6 is introduced into a casing 19 of the supply pump 3 via a pipeline 20, and each sliding part in the supply pump 3 is lubricated with the fuel.

The ECU 18 conducts overall electronic control of the device, the opening/closing control of the injectors 1 being mainly executed based on the operation state (for example, engine revolution speed, engine load, and the like) of the engine. Fuel injection is implemented and terminated according to ON/OFF of the electromagnetic solenoids of injectors 1.

Furthermore, the ECU 18 also controls the opening degree and opening/closing timing of the metering valve 7 according to the operation state of the engine, thereby conducting feedback control of the common rail pressure. Thus, the target common rail pressure based on the engine operation state is determined by the ECU 18, and the metering valve 7 is controlled by the ECU 18 so that the actual common rail pressure matches the target common rail pressure. For example, if the actual common rail pressure becomes greatly below the target common rail pressure, the metering valve 7 is controlled so that the opening degree thereof is increased and/or the opening period thereof is extended, and the amount of fuel pumped from the supply valve 3 is increased.

A variety of sensors are provided to detect the operation state of the engine and the vehicle carrying the engine. Those sensors include a crank sensor 22 for detecting the crank angle of the engine, an accelerator opening degree sensor 23 for detecting the accelerator opening degree, an accelerator switch 24 for detecting whether the accelerator opening degree is 0 or not, and a gear position sensor 25 for detecting the gear position (neutral including) of the transmission. Those sensors are electrically connected to the ECU 18. Further, the ECU 18 computes the engine revolution speed based on the output pulse of the crank sensor 22. In addition, a pressure sensor 21 for detecting the actual common rail pressure is provided in the common rail 2, and this pressure sensor 21 is also electrically connected to the ECU 18.

The feedback control method of the common rail pressure will be described below. As shown in FIG. 1, the control is executed for each control period Δt=30 CA, and the processing flow shown in the flowcharts in FIGS. 4 and 5 is executed by the ECU 18 in each control timing (period).

Figure 4:
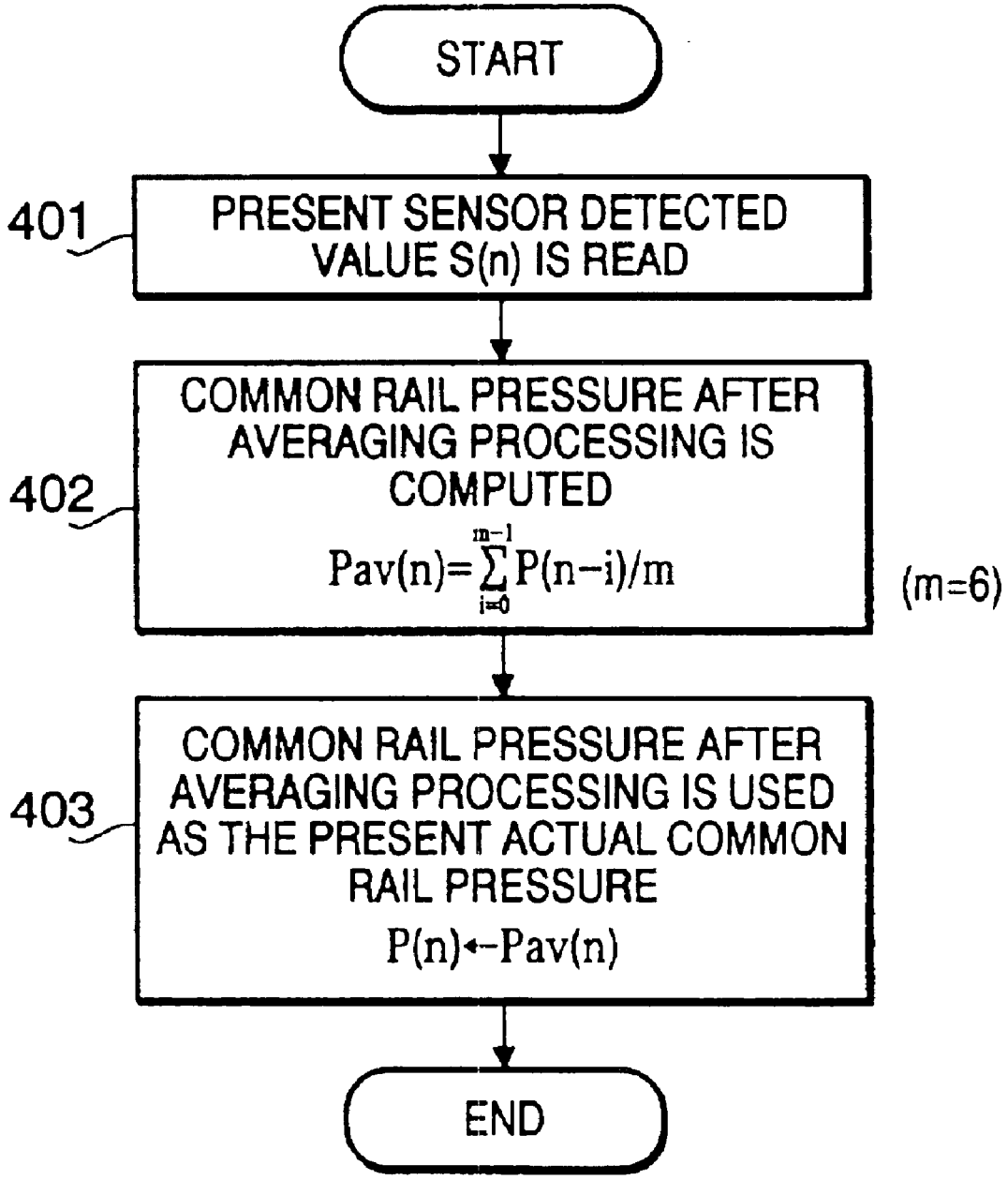
FIG. 4 is a flow chart illustrating the contents of filtering processing of common rail pressure of the embodiment of the present invention.
Figure 5:
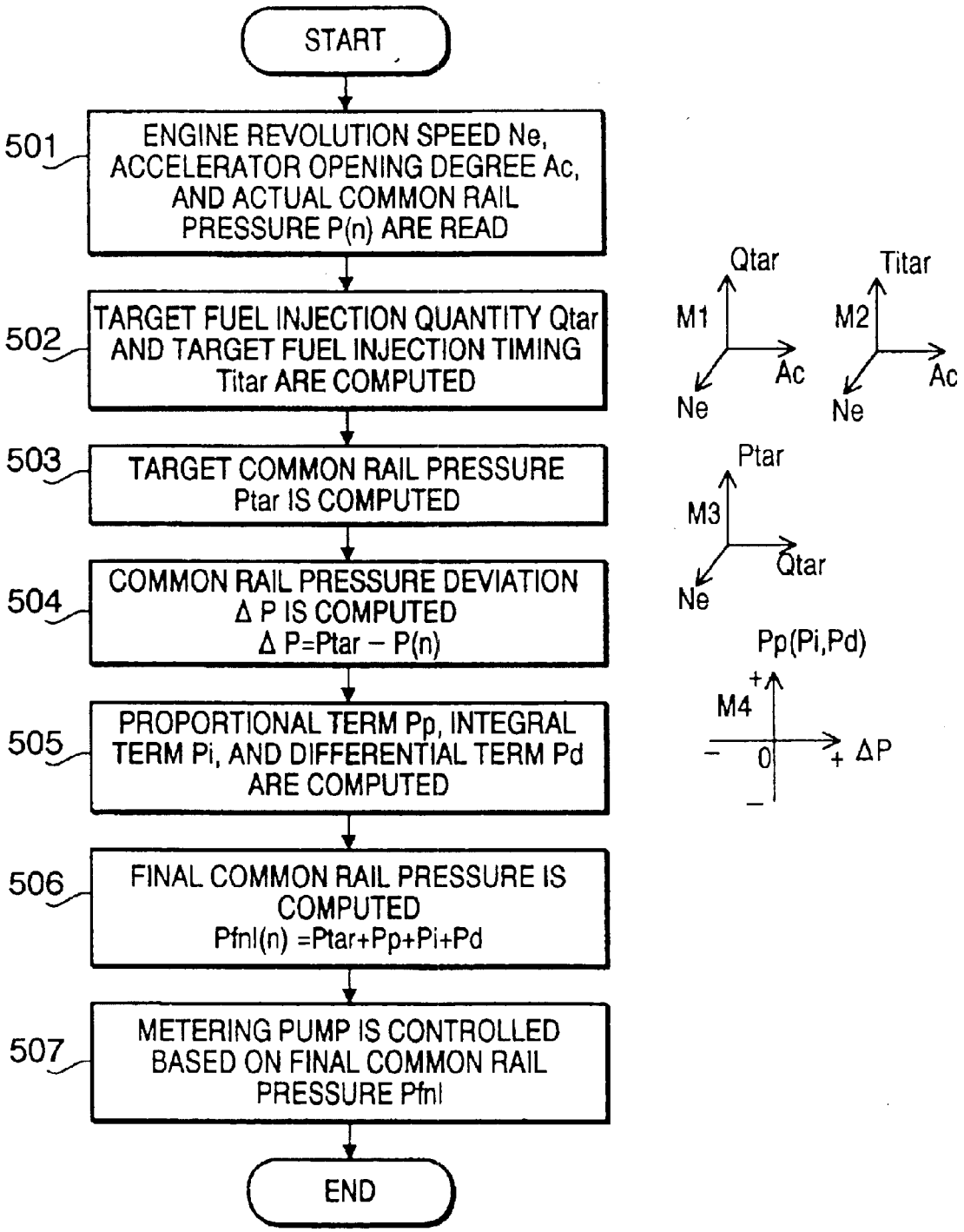
FIG. 5 is a flow chart illustrating the contents of feedback control of common rail pressure of the embodiment of the present invention.

FIG. 4 illustrates the contents of filter processing of the values (sensor detected values) of the actual common rail pressure detected by the pressure sensor 21. This processing is executed repeatedly for each control timing, and sensor detected values are read in the ECU 18 for each control timing. Therefore, the reading period of the sensor detected values coincides with the control period Δt. The sensor detected values that were read in are stored in the ECU 18 only in the number thereof which is sufficient for this control.

In step 401, the sensor detected value S(n) in the present control timing is read in the ECU 18.

In step 402, m (in the present embodiment, m=6) preceding sensor detected values S(n), S(n−1), S(n−2), . . . S(n−(m−1)) are averaged and the common rail pressure Pav(n) after averaging processing is computed based on the following formula.

$$Pav(n) = \sum_{i=0}^{m-1} (n-i)/m \qquad \text{[Formula 1]}$$

m is the value obtained by dividing the pumping cycle ΔT of the supply pump 3 by the reading period Δt, and in the present embodiment it is 180 CA/30 CA=6. In other words, a total of six sensor detected values are obtained within one pumping cycle ΔT. If those six sensor detected values are averaged, then one waveform of common rail pressure fluctuations caused by one pumping of the supply valve 3 can be almost entirely included and averaged.

In step 403, the common rail pressure Pav(n) after averaging processing that was obtained in step 402 is replaced with the actual common rail pressure P(n) which is a representative value of the present actual common rail pressure. This completes the present filter processing.

This processing will be explained with reference to FIG. 1. For example, in the control timing t1, a total of six sensor detected values within the range shown by symbol I are averaged and a common rail pressure Pav(1) after averaging processing is computed. Then, in a similar manner, in the control timing t2, a total of six sensor detected values within the range shown by symbol II are averaged and a common rail pressure Pav(2) after averaging processing is computed, and in the control timing t3, a total of six sensor detected values within the range shown by symbol III are averaged and a common rail pressure Pav(3) after averaging processing is computed. Thus, in accordance with the present invention, the representative values of the actual common rail pressure are successively computed by moving averaging.

In accordance with the present invention, the reading period of sensor detected values is set at least to a crank angle period of no more than half the pumping cycle of the supply pump. Further, in the present embodiment, the reading period is _t=30 CA and is shorter than 90 CA, whish is half of the pumping cycle _T=180 CA of the supply pump 3. The reading period is set to a crank angle period of no more than half the pumping cycle because in this case the moving averaging can be conducted by smartly balancing the peak values and valley values within one fluctuation period of the common rail pressure.

Further, in accordance with the present invention, values detected by the sensor within one pumping cycle preceding a certain reading time are read in, but the expression "one pumping cycle preceding" does not include "the time that was exactly one pumping cycle before". This time can be also called the beginning of the second preceding pumping cycle. Thus, in the example shown in FIG. 1, when the control timing is t1, sensor detected values S(1)-S(−4) are read, and the sensor detected value S(−5) which is exactly one pumping cycle before is not read.

Further, with this processing method, the averaging interval (or sampling interval) is one pumping cycle ΔT of the supply pump 3, that is, one pulsation period of the actual common rail pressure, and processing is executed in which the sensor detected values within this period are read and averaged. Therefore, the averaging interval is not uselessly extended and representative values or control values close to actual values can be obtained by collecting all the sensor detected values within one pulsation period. Therefore, the response delay in feedback control of common rail pressure can be reduced to a minimum and a representative value of the common rail pressure with small fluctuations allowing it to be used for control can be obtained.

Figure 2:
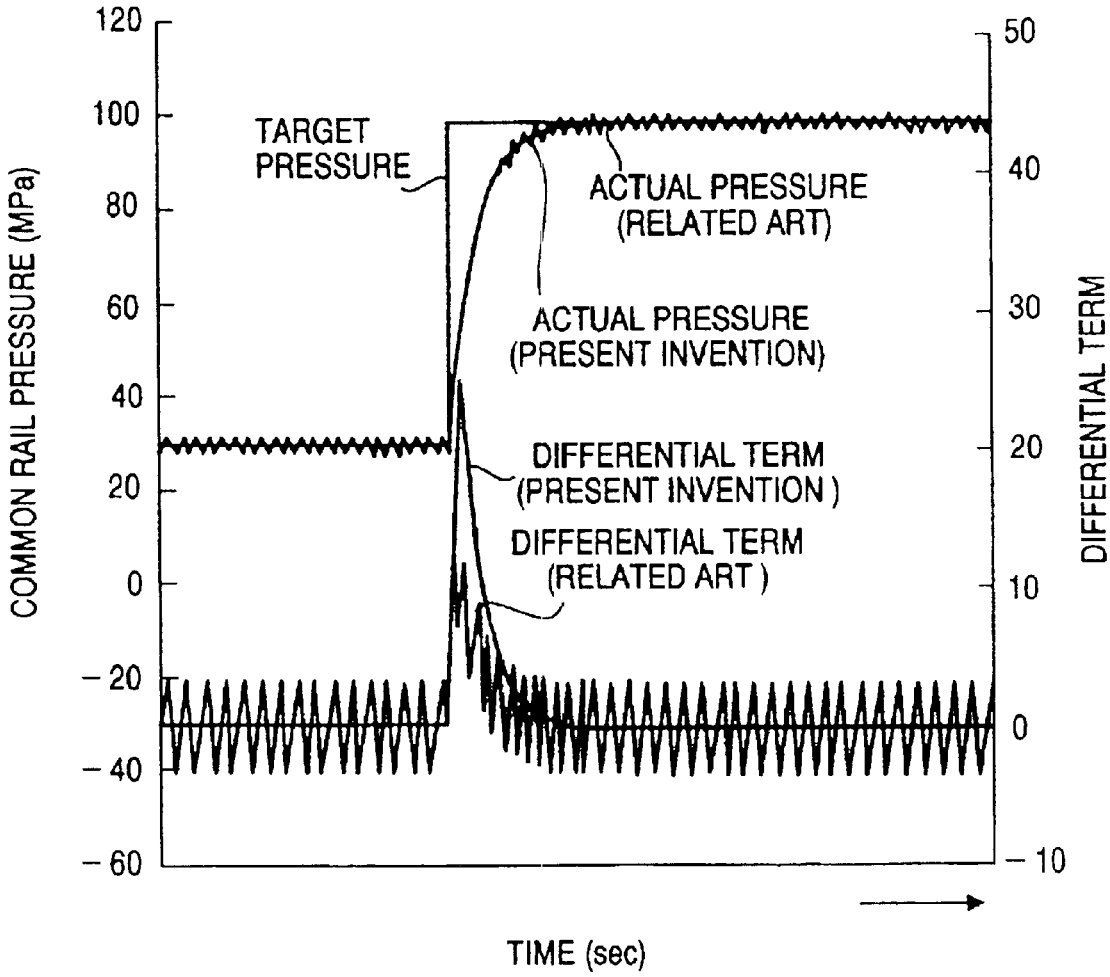
FIG. 2 is a diagram comparing the changing patterns of representative values of common rail pressure and differential term.

The results obtained with this processing method are shown in FIG. 2. With the feedback control of common rail pressure, as shown in the figure, the actual common rail pressure ("actual pressure") follows the target common rail pressure ("target pressure"), but because the value of the common rail pressure relating to control has heretofore been the sensor detected value itself, the fluctuations of the differential term and the actual pressure based on the pumping of the supply pump were significant. By contrast, with the common rail pressure Pav(n) (or actual common rail pressure P(n)) after averaging processing which is described as "the actual pressure (present invention)", such fluctuations are eliminated. For this reason, the fluctuations of the value of the differential term determined based on the deviation of the common rail pressure Pav(n) after averaging processing from the target common rail pressure (described as "differential term (present invention)" is also eliminated and the values of the two can be advantageously used for the control.

The method for feedback control of the common rail pressure of the present embodiment which uses the actual common rail pressure P(n) obtained by the above-described averaging will be described below with reference to FIG. 5. The processing flow shown in the figure is repeatedly executed by the ECU 18 with a control timing for each control period Δt, in the same manner as described hereinabove, and the timing of this execution is identical to that of the flow shown in FIG. 4. A map for computing the below-described control values is created based on the results of actual engine tests conducted in advance and is stored in the ECU 6.

As a modification example, a procedure in which the flow shown in FIG. 4 and the flow shown in FIG. 5 are not executed with the same timing can be considered. In this case, it is preferred that the value of the actual common rail pressure P(n) obtained by the processing flow shown in FIG. 4 prior to executing the processing flow shown in FIG. 5 be used at the time of executing the processing flow shown in FIG. 5.

In step 501, an engine revolution speed Ne calculated based on the output pulse of the crank sensor 22, an accelerator opening degree Ac detected by the accelerator opening sensor 23, and an actual common rail pressure P(n) obtained by the above-described averaging are read.

In step 502, a target fuel injection amount Qtar and a target fuel injection timing Titar are computed according to a target fuel injection amount computation map M1 and a target fuel injection timing computation map M2 based on the values of the engine revolution speed Ne and accelerator opening degree Ac. The target fuel injection amount Qtar and the target fuel injection timing Titar that will be computed may be corrected according to engine temperature or atmospheric pressure.

In step 503, a target common rail pressure Ptar is computed according to a target common rail pressure computation map M3 based on the values of the target fuel injection amount Qtar and the engine revolution speed Ne.

In step 504, the difference ΔP between the target common rail pressure Ptar and the actual common rail pressure P(n) is computed by the formula ΔP=Ptar−P(n).

In step 505, a proportional term Pp, an integral term Pi, and a differential term Pd are computed according to respective proportional term computation map, integral term computation map, and differential term computation map (all those maps are denoted together as M4) based on the difference ΔP.

In step 506, each of the proportional term Pp, integral term Pi, and differential term Pd is added to the target common rail pressure Ptar, and a final common rail pressure Pfnl(n) is computed.

In step 507, the metering valve 7 is controlled based on the final common rail pressure Pfnl(n), that is, the opening degree, opening timing, and opening interval of the metering valve 7 are controlled so that the pumping of fuel in an amount corresponding to the final common rail pressure Pfnl(n) is conducted by the supply pump 3.

With the above-described method for feedback controlling the common rail pressure, the value of the actual common rail pressure P(n) after averaging processing, from which the effect of pressure pulsations has been removed, is used as the representative value of the actual common rail pressure. Therefore, the controllability is improved and the control accuracy can be increased.

With the above-described method for feedback controlling the common rail pressure, the common rail pressure Pav(n) after averaging processing was computed by averaging the sensor detected values for each prescribed crank angle period Δt=30 CA, and the control was conducted by using this value. However, if the same approach is followed when the engine revolution speed is low, the idle time of the control system is increased and the control response delay can occur.

In such cases, when the engine revolution speed is a low speed below the prescribed value, the control may be conducted by directly using the values detected by the sensor for each prescribed time period (for example, for every 8 msec), without using the above-described values computed for each crank angle period. Thus, when the engine revolution speed is not less than the prescribed value, the time elapsing within a crank angle period Δt=30 CA is comparatively short. Therefore, the control is conducted by using the values of the above-described common rail pressure Pav(n) after averaging processing. Conversely, when the engine revolution speed is a low speed below the prescribed value, a comparatively long time is required for a crank angle period Δt=30 CA. Therefore, the control may be conducted by directly using the values detected by the sensor for each time period (for example, for every 8 msec), without using values of the above-described common rail pressure Pav(n) after averaging processing. As a result, the extension of the idle period of the control system and the response delay of the control can be prevented.

Various other embodiments of the present invention can be considered. For example, in the present embodiment, the pumping cycle of the supply pump was ΔT=180 CA and the reading period of sensor detected values was Δt=30 CA. However, those values can be changed. For example, with a supply pump conducting three cycles of fuel pumping per one crankshaft revolution, one pumping cycle becomes ΔT=120 CA. Furthermore, in the present embodiment an example was considered in which fuel pumping and injection were synchronized. However, in the common rail fuel injection control devices, pumping and injection can be asynchronous. For example, there is a combination of a six cylinder engine and a supply pump with four cycles of pumping per two crankshaft revolutions. The present invention is also applicable to such devices.

In sum, the present invention exhibits excellent effects, that is, makes it possible to convert the actual common rail pressure into values that can be advantageously used for control and allows the feedback control of common rail pressure to be executed with higher accuracy.

What is claimed is:

1. A filter processing device for detected values of common rail pressure, comprising:

a common rail for accumulating a high-pressure fuel;

a supply pump synchronously driven by an engine and pumping the fuel to said common rail in constant pumping cycles;

a pressure sensor for detecting the actual common rail pressure; and computation means for reading the detected values of the common rail pressure obtained by said pressure sensor within crank angle periods which are at least not more than half of said pumping cycle, averaging, the respective values detected within one pumping cycle preceding each of the reading times, and using the value thus obtained as a common rail pressure after averaging processing, which is a representative value of the actual common rail pressure.

2. A common rail fuel injection control device comprising:

means for determining a target common rail pressure based on the actual engine operation state; and pump pumping quantity control means for computing the difference between the target common rail pressure and the actual common rail pressure and feedback controlling the pumping quantity of a supply pump based on the difference so that the actual common rail pressure coincides with the target common rail pressure, wherein said pump pumping quantity control means uses the values of said common rail pressure after averaging processing that were obtained by the filter processing device for detected values of common rail pressure of claim 1, as the representative values of actual common rail pressure.

3. The common rail fuel injection control device according to claim 2, wherein:

said pump pumping quantity control means uses, as the representative values of actual common rail pressure, the values of said common rail pressure after averaging processing only when the engine revolution speed is not less than a prescribed value, and directly uses the detected values that were detected by said pressure sensor for each prescribed time period when the engine revolution speed is less than the prescribed value.

* * * * *